US007373975B2

(12) United States Patent
Dion et al.

(10) Patent No.: US 7,373,975 B2
(45) Date of Patent: May 20, 2008

(54) DOWNHOLE RECORDER SYSTEM

(75) Inventors: Dominique Dion, Plaisir (FR); James Mayes, Sugar Land, TX (US); Onur Ozen, Clamart (FR); Lionel Beneteau, Houston, TX (US); Lionel Pin, Meylan (FR); Thierry Leroy, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 234 days.

(21) Appl. No.: 11/131,527

(22) Filed: May 18, 2005

(65) Prior Publication Data

US 2006/0085134 A1 Apr. 20, 2006

(51) Int. Cl.
*E21B 47/00* (2006.01)

(52) U.S. Cl. ..... 166/250.01; 175/40

(58) Field of Classification Search ..... 166/250.01; 175/40; 702/6, 9

See application file for complete search history.

(56) References Cited

U.S. PATENT DOCUMENTS 5,202,680 A * 4/1993 Savage ..... 340/853.1
5,360,967 A * 11/1994 Perkin et al. ..... 235/375
5,491,637 A * 2/1996 Kraemer et al. ..... 700/115
5,749,417 A * 5/1998 Delatorre ..... 166/254.2
6,272,434 B1 8/2001 Wisler et al.
6,333,700 B1 * 12/2001 Thomeer et al. ..... 340/854.8
6,347,292 B1 * 2/2002 Denny et al. ..... 702/188
6,626,251 B1 9/2003 Sullivan et al.
2002/0014966 A1 * 2/2002 Strassner et al. ..... 340/572.1

FOREIGN PATENT DOCUMENTS

EP 0 728 915 8/1996
GB 2 389 601 12/2003

* cited by examiner

*Primary Examiner*—Jennifer H Gay
*Assistant Examiner*—David Andrews
(74) *Attorney, Agent, or Firm*—James Kurka; Bryan L. White; Darla Fanseca

(57) ABSTRACT

A downhole recorder system for use with a downhole assembly to be lowered into a borehole comprises at least one recorder uniquely associated to a determined sub-assembly of the downhole assembly. The at least one recorder allows to store operating data related to the determined sub-assembly. The stored operating data are extractable at least when the determined sub-assembly is disassembled from the downhole assembly.

16 Claims, 5 Drawing Sheets

DOWNHOLE RECORDER SYSTEM

CROSS-REFERENCE TO RELATED APPLICATIONS

This application claims priority to European Patent Application EP04291275.8 entitled "Downhole Recorder System," filed on May 19, 2004 by Dion et al.

BACKGROUND OF THE INVENTION

1. Field of the Invention

The invention relates generally to downhole recorders for use with a downhole assembly.

2. Background Art

A downhole assembly is used within a borehole, for example for drilling the borehole itself, or for characterizing a formation surrounding the borehole. The downhole assembly, when lowered into the borehole, may be subject to extreme conditions, e.g. high pressures, high temperatures. The downhole assembly may subsequently be worn down or damaged. Maintenance operations are hence performed on the downhole assembly.

In order to evaluate a state of the downhole assembly, operating data, e.g. a date of repair, a nature of the repair, a peak of temperature measured downhole, are traditionally written on paper or into a computer file. The writing of the operating data allows to constitute a database of the operating data. A lifetime of the downhole assembly or of a sub-assembly of the downhole assembly may be evaluated from the operating database.

Sensors located downhole allow to perform measurements of environment parameters, e.g. temperature, shock events, vibration events, humidity rate, number of ON/OFF cycles, pressure, supply voltage and currents, flow rate of a liquid, rotating velocity of a collar of the downhole assembly. The sensors are traditionally read at surface following a raising operation.

A recorder mounted on the downhole assembly allows to provide a downhole storage of the operating data. Typically, the sensors are connected to the recorder and measured environment data are written into the recorder.

When the downhole assembly is raised up to a surface, the recorder is read and at least a portion of a content of the recorder is transferred into a computer.

FIG. 1 illustrates an example of a downhole assembly from prior art. The downhole assembly 11 is lowered into a borehole 12. In the example represented in FIG. 1, the downhole assembly 11 is lowered by means of a wireline cable 17. The downhole assembly 11 comprises a logging tool (not represented) allowing to characterize a formation 18 surrounding the borehole 12.

Sensors 13 allow to measure environment data that are subsequently written into a recorder 15. The measured environment data may be read at the recorder when the downhole assembly is raised to the surface. Alternatively, as represented in FIG. 1, an electrical cable 19 allows to read the measured environment data from a computer 16 located at the surface.

An operating database may be constructed from the read environment data and from maintenance data stored either in the recorder 15 or directly in the computer 16. A lifetime of the downhole assembly 11 may be evaluated from the operating database, according to a reliability model.

The downhole assembly 11 usually comprises at least one sub-assembly 14, e.g. a collar (not represented), a drill bit (not represented). The sensors 13 themselves may also be considered as a sub-assembly. The computer 16 may allow to evaluate a lifetime of each one of the sub-assemblies 14. A plurality of sub-assembly reliability models, each sub-assembly reliability model allowing to evaluate the lifetime of a determined sub-assembly, may be used for that purpose.

SUMMARY OF INVENTION

In a first aspect, the invention provides a downhole recorder system for use with a downhole assembly to be lowered into a borehole. The downhole recorder system comprises at least one recorder uniquely associated to a determined sub-assembly of the downhole assembly. The at least one recorder allows to store operating data related to the determined sub-assembly. The stored operating data are extractable at least when the determined sub-assembly is disassembled from the downhole assembly.

In a first preferred embodiment, the operating data comprise environment data relating to at least one environment parameter.

In a second preferred embodiment, the operating data comprise maintenance data.

In a third preferred embodiment, the operating data comprise manufacturing data.

In a fourth preferred embodiment, at least one common sensor communicates with more than one recorder. A common sensor allows to measure an environment parameter.

In a fifth preferred embodiment, the downhole recorder system further comprises at least one sub-assembly sensor, a sub-assembly sensor being attached to a specific sub-assembly. The sub-assembly sensor allows to measure an environment parameter. The measured environment parameter is stored by the recorder associated to the sub-assembly corresponding to the sub-assembly sensor.

In a sixth preferred embodiment, the downhole recorder system further comprises at least one integrated sensor, an integrated sensor being part of a recorder among the at least one recorders. The integrated sensor allows to measure an environment parameter.

In a seventh preferred embodiment, a controller communicates with each recorder.

In an eighth preferred embodiment, processing means are located at a surface. The processing means allow to analyze the stored operating data. The downhole recorder system further comprises downloading means to download the stored operating data from a recorder to the processing means.

In a second aspect, the invention provides a method for tracking at least one sub-assembly of a downhole assembly with a downhole recorder system. The method comprises individually storing operating data for a determined sub-assembly. The stored operating data are individually extractable.

In a ninth preferred embodiment, a value an environment parameter is measured. The method further comprises individually storing as environment data the measured value.

In a tenth preferred embodiment, the method further comprises individually storing maintenance data relating to a maintenance operation performed at the determined sub-assembly.

In an eleventh preferred embodiment, the individually stored operating data are downloaded. The downloaded operating data are processed to determine a lifetime of the determined sub-assembly, according to a corresponding sub-assembly reliability model.

In a twelfth preferred embodiment, the at least one sub-assembly reliability model is adjusted a posteriori with the downloaded operating data.

In a third aspect, the invention provides a wireline system for use in a borehole. The wireline system comprises at least one sub-assembly and a downhole recorder system according to the first aspect of the invention.

In a fourth aspect, the invention provides a drilling machine for use in a borehole. The drilling machine comprises at least one sub-assembly and a downhole recorder system according to the first aspect of the invention.

Other aspects and advantages of the invention will be apparent from the following description and the appended claims.

DETAILED DESCRIPTION

A downhole assembly may be tracked so as to allow an evaluating of a state of the downhole assembly. A recorder is provided to store operating data in a non-volatile memory. An operating database may be constructed from the operating data: the operating database allows to evaluate a lifetime of the downhole assembly.

The downhole assembly typically comprises at least one sub-assembly. During a lifetime of the downhole assembly, a determined sub-assembly may be replaced several times due to a shorter lifetime of the determined sub-assembly as compared to a lifetime of the downhole assembly or of other sub-assemblies of the downhole assembly. A new sub-assembly may be inserted, e.g. a new sensor. The downhole assembly may also be dismantled and a sub-assembly may be reused in a distinct downhole assembly. The operating data are stored in a single recorder: in any one of those latter cases, the operating data relative to a displaced sub-assembly may be lost.

There is a need for a system providing an improved tracking of one or a plurality of sub-assemblies so as to remedy to the loss of sub-assembly operating data.

Figure 1:
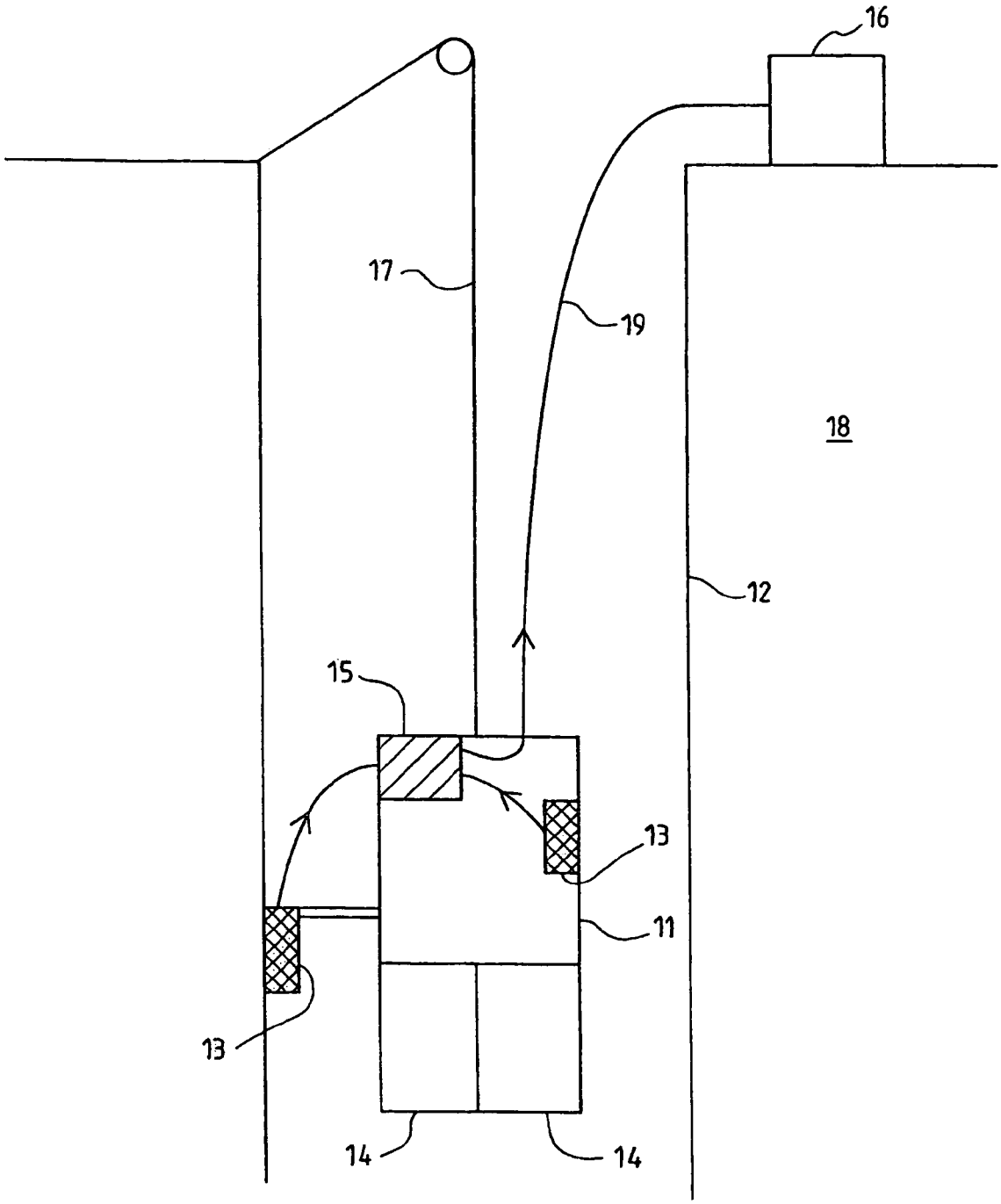
FIG.1 PRIOR ART
FIG. 1 illustrates an example of a downhole assembly from prior art.
Figure 2:
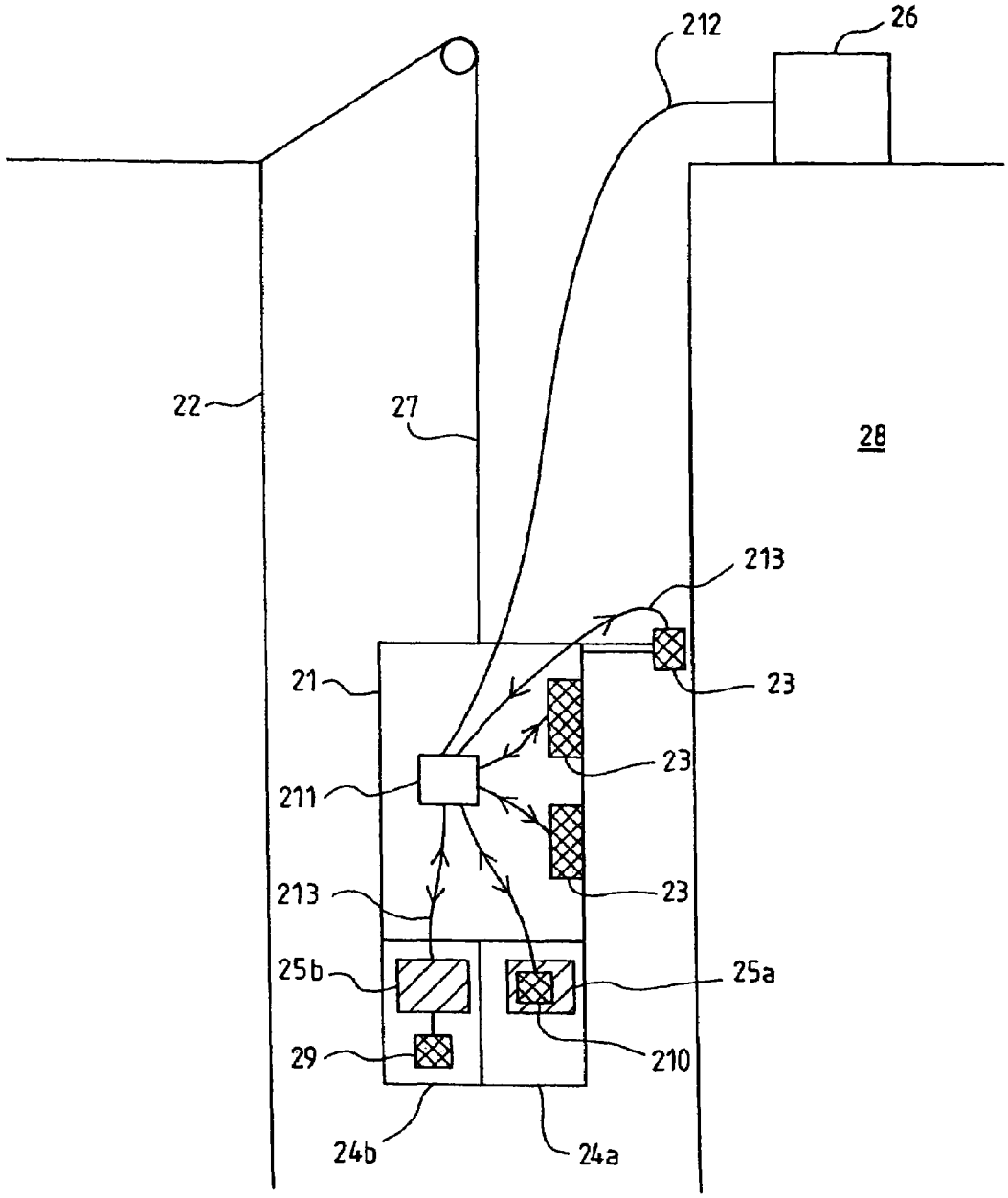
FIG. 2 illustrates an example of a downhole assembly according to a first embodiment of the present invention.

FIG. 2 illustrates an example of a downhole assembly according to a first embodiment of the present invention.

The downhole assembly 21 is adapted to be lowered into a borehole 22. A downhole recorder system comprises at least one recorder (25*a*, 25*b*) uniquely associated to a determined sub-assembly (24*a*, 24*b*) of the downhole assembly 21. The at least one recorder (25*a*, 25*b*) allows to store operating data related to the determined sub-assembly (24*a*, 24*b*). The stored operating data are extractable at least when the determined sub-assembly is disassembled from the downhole assembly.

If a determined sub-assembly (24*a*, 24*b*) is disassembled from the downhole assembly 21, e.g. for a disposal or for a further use within a distinct downhole assembly, the operating data stored into the associated recorder (25*a*, 25*b*) may be extracted to follow the determined sub-assembly (24*a*, 24*b*). The present invention hence provides an individualized storing of the operating data for the determined sub-assembly (24*a*, 24*b*). A tracking of the determined sub-assembly is rendered easier than in the systems from prior art wherein operating data relative to the determined sub-assembly and to other parts of the downhole assembly are stored within a single recorder.

The downhole assembly may comprise a single sub-assembly. In this latter case, the downhole recorder system comprises a recorder that is uniquely associated to the single sub-assembly. Operating data for the single sub-assembly are individually stored within the recorder. If the single sub-assembly is disassembled from the downhole assembly, the recorder may be extracted to follow the single sub-assembly.

As represented in FIG. 2, the downhole assembly may also comprise a plurality of sub-assemblies (24*a*, 24*b*) and a plurality of recorders (25*a*, 25*b*). Each recorder (25*a*, 25*b*) is uniquely associated to a determined sub-assembly (24*a*, 24*b*) among the plurality of sub-assemblies (24*a*, 24*b*). Operating data for each determined sub-assembly (24*a*, 24*b*) are individually stored within the associated recorder (25*a*, 25*b*). The operating data stored into a determined recorder (25*a*, 25*b*) are individually extractable.

The recorders (25*a*, 25*b*) may be for example part of the associated sub-assemblies (24*a*, 24*b*).

Alternatively, the recorders are attached to the associated sub-assemblies. The recorders may also be grouped into a recorder tool located downhole, at a relatively high distance from the associated sub-assemblies.

The operating data typically comprise environment data, i.e. measurements of environment parameters. The environment parameters may be for example temperature, shock events, vibration events, and humidity rate. The environment data are measured at a sensor (23, 29, 210).

The sensor may be a common sensor 23 communicating with more than one recorder. The common sensor 23 allows to measure an environment parameter. Typically, the environment parameter is correlated to lifetimes of a plurality of sub-assemblies and the environment parameter may be substantially uniform over a length of the downhole assembly.

The sensor may also communicate with a single recorder, in particular if an environment parameter to be measured by the sensor varies a lot with a distance to the associated sub-assembly. The environment parameter to be measured by the sensor may also be of particular interest for the associated sub-assembly only.

Preferably a controller 211 communicates with the plurality of recorders (25*a*, 25*b*). The common sensors 23 may communicate with the corresponding recorders (25*a*, 25*b*) via the controller 211.

The sensor may also be a sub-assembly sensor 29 that is attached to a specific sub-assembly 24*b*. The sub-assembly sensor 29 allows to measure an environment parameter. The measured environment parameter is stored within the recorder 25*b* associated to the sub-assembly 24*b* corresponding to the sub-assembly sensor 29.

The sensor may also be an integrated sensor 210 that is part of a recorder 25*a* among the at least one recorders (25*a*, 25*b*). The integrated sensor 210 allows to measure an environment parameter. Typically, the integrated sensor 210 is a micro-sensor having a relatively small size. The integrated sensor 210 may for example be a temperature sensor or a shock sensor.

The system of the present invention may, as represented in FIG. 2 comprise a plurality of sensors (23, 29, 210) that communicate with one or more recorders (25*a*, 25*b*). The communicating may be in a single direction, i.e. from the sensors to the recorders, or in both directions, as represented in FIG. 2. In this latter case, the controller 211 may further comprise adjusting means to control the sensors (23, 29, 210): the adjusting means may for example allow to calibrate the sensors (23, 29, 210).

Preferably the recorders (25*a*, 25*b*) are wired independently from other functions of the downhole assembly 21. For example, if the downhole assembly 21 comprises a logging tool (not represented on FIG. 2) allowing to measure logging data of a formation 28 surrounding the borehole 22, a logging circuit (not represented on FIG. 2) may be provided for a transportation of the logging data either up to the surface or to a logging memory. Electrical wires 213 dedicated to the communicating with the recorder are independent from the logging circuit. The electrical wires 213 may even have a higher reliability than the logging circuit so as to insure that the operating data stored into the recorders (25*a*, 25*b*) are retrieved in a case of a failure of the logging tool. The stored operating data may be subsequently used for an analysis of the failure.

Alternatively the recorders, the sensors and the controller communicate with any other communicating means, e.g. electromagnetic waves.

The recorders (25*a*, 25*b*) allow to store operating data. The operating data may be environment data measured at the sensors 23. The operating data may also comprise maintenance data, i.e. data relating to maintenance operations performed on the associated sub-assembly such as a nature of a repair, a time of the repair, a place of the repair etc. The operating data may also comprise manufacturing data, i.e. data relating to a manufacturing of the associated sub-assembly such as a time of manufacture.

The system of the present invention may further comprise processing means 26 located at surface. The processing means 26 are typically constituted of a computer. The processing means 26 allow to analyze the operating data stored into the recorders (25*a*, 25*b*). Downloading means, e.g. an electrical cable 212, allow to download the stored operating data from a recorder among the at least one recorders to the processing means 26. The downloading means may also be a telemetry system or any other system allowing to download the data from the recorders (25*a*, 25*b*).

The downloading may be performed periodically or continuously. The downloading allows to construct an operating database at the computer. The operating database may be processed either automatically or on demand, to determine a life time of at least one sub-assembly (24*a*, 24*b*), according to a corresponding sub-assembly reliability model and according to further operating conditions.

The downhole assembly 21 may be a wireline system, as in the example represented in FIG. 2. The wireline system is lowered into the borehole 22 by a wireline cable 27. Alternatively, the downhole assembly may be any other system located downhole.

Figure 3:
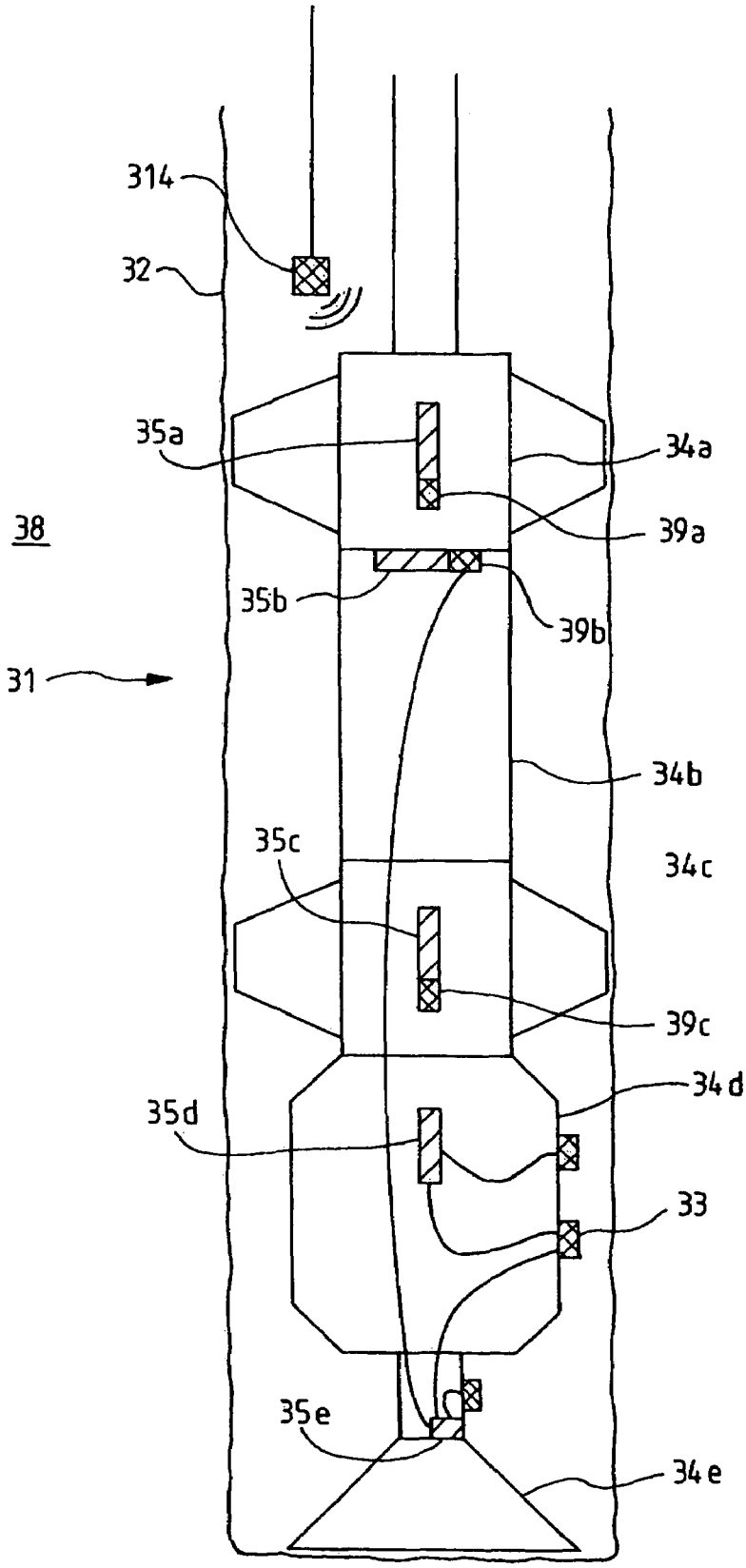
FIG. 3 illustrates an example of a downhole assembly according to a second embodiment of the present invention.

FIG. 3 illustrates an example of a downhole assembly according to a second embodiment of the present invention. In the example represented in FIG. 3, the downhole assembly 31 is a drilling machine. The downhole assembly 31 comprises a plurality of sub-assemblies (34*a*, 34*b*, 34*c*, 34*d*, 34*e*). The plurality of sub-assemblies (34*a*, 34*b*, 34*c*, 34*d*, 34*e*) comprises a first stabilizer 34*a*, a second stabilizer 34*c*, a motor 34*b*, a collar 34*d* and a drill bit 34*e*. The drilling machine 31 allows to drill a borehole 32 into a formation 38.

A plurality of recorders (35*a*, 35*b*, 35*c*, 35*d*, 35*e*) is provided, each recorder (35*a*, 35*b*, 35*c*, 35*d*, 35*e*) being associated to a determined sub-assembly (34*a*, 34*b*, 34*c*, 34*d*, 34*e*). Each recorder (35*a*, 35*b*, 35*c*, 35*d*, 35*e*) allows to store operating data.

The operating data stored into a determined recorder (35*a*, 35*b*, 35*c*, 35*d*, 35*e*) are preferably correlated to a lifetime of the associated sub-assembly (34*a*, 34*b*, 34*c*, 34*d*, 34*e*). A plurality of sensors (33, 39*a*, 39*b*, 39*c*, 314) may be provided to measure environment data relating to environment parameters.

A common sensor 33 communicating with more than one recorder (35*d*, 35*e*) may be provided. In the example represented in FIG. 3, the common sensor 33 communicates directly with the more than one recorders (35*d*, 35*e*).

Sub-assembly sensors (39*a*, 39*b*, 39*c*) are also represented on FIG. 3. Each sub-assembly sensor (39*a*, 39*b*, 39*c*) is attached to a specific sub-assembly (34*a*, 34*b*, 34*c*).

A wireline sensor 314 may also be provided. The wireline sensor 314 may communicate with the recorder 39*a* for example via electromagnetic waves.

Figure 4:
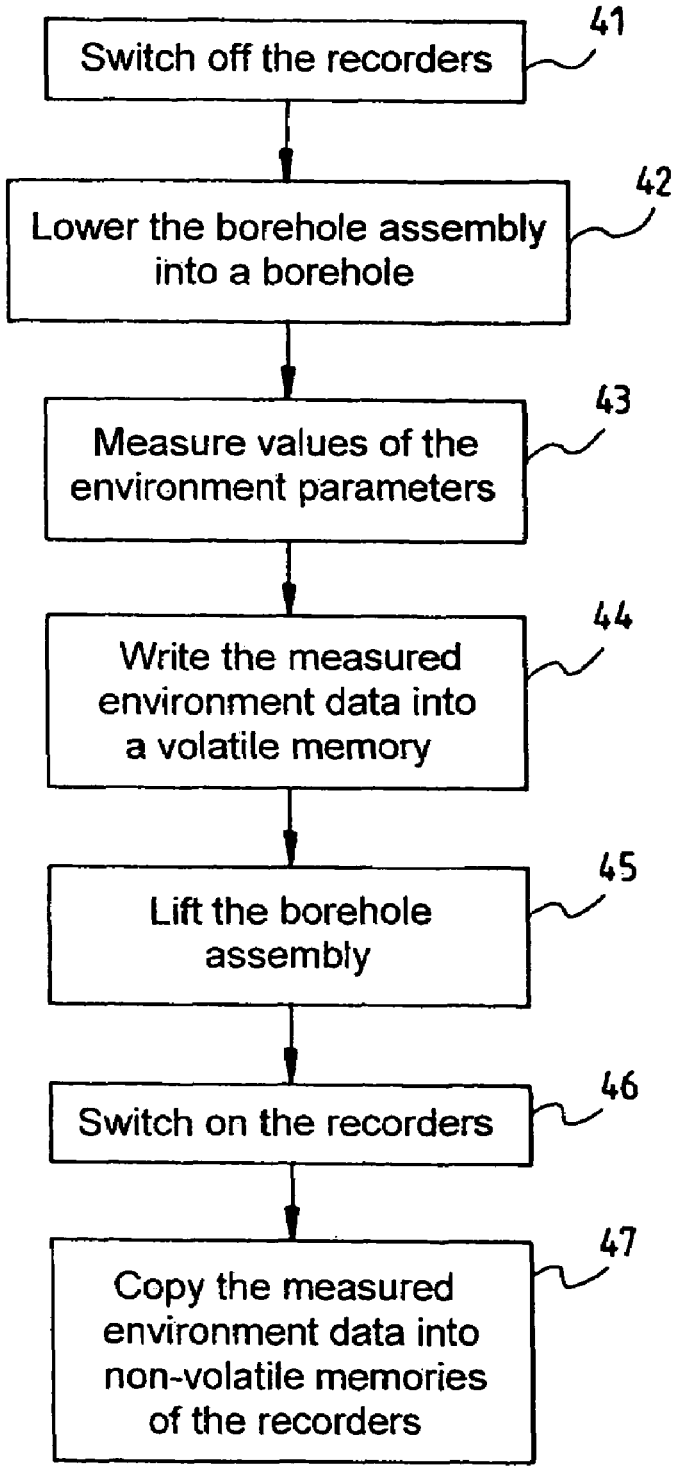
FIG. 4 is a flowchart illustrating an example of a method for recording environment data according to a third embodiment of the present invention.

FIG. 4 is a flowchart illustrating an example of a method for recording environment data according to a third embodiment of the present invention. The method illustrated in FIG. 4 allows to store measured environment data into a downhole recorder system comprising a plurality of recorders. A downhole assembly comprises a plurality of sub-assemblies. Each recorder is uniquely associated to a determined sub-assembly.

In the example of FIG. 4, the recorders comprise a non-volatile memory, e.g. an EEPROM that communicates with a volatile memory. A single volatile memory communicating with a plurality of non-volatile memories of the recorders may be provided. Alternatively, each non-volatile memory communicates with a dedicated volatile memory.

The recorders are switched off (box 41) to avoid damaging. The downhole assembly is lowered into the borehole following the switching off (box 42). Sensors perform measurements of environments parameters (box 43). The measured environment data are written into the volatile memory (box 44). The volatile memory remains active even after the switching off of the recorders.

When the downhole assembly is lifted (box 45), the recorders are switched on (box 46). The downhole assembly may be lifted to a surface or to a zone of the borehole with less extreme conditions than a zone of measurements.

The measured environment data are copied from the volatile memory to the non-volatile memory of the recorders (box 47).

The lifting and the copying are typically performed at an end of a downhole operation executed by the downhole assembly while downhole. The volatile memory is subsequently re-initialized for a further downhole operation.

In a first alternative embodiment (not represented), the lifting and the copying of the measured environment data may be performed at regular intervals, e.g. every 10 minutes.

In a second alternative embodiment (not represented), the recorders remain active. The measured data are directly written from the sensors to the non-volatile memories of the recorders.

Such a recording of measured environment data may be followed by a processing of the environment data so as to determine a lifetime of the sub-assemblies.

Figure 5:
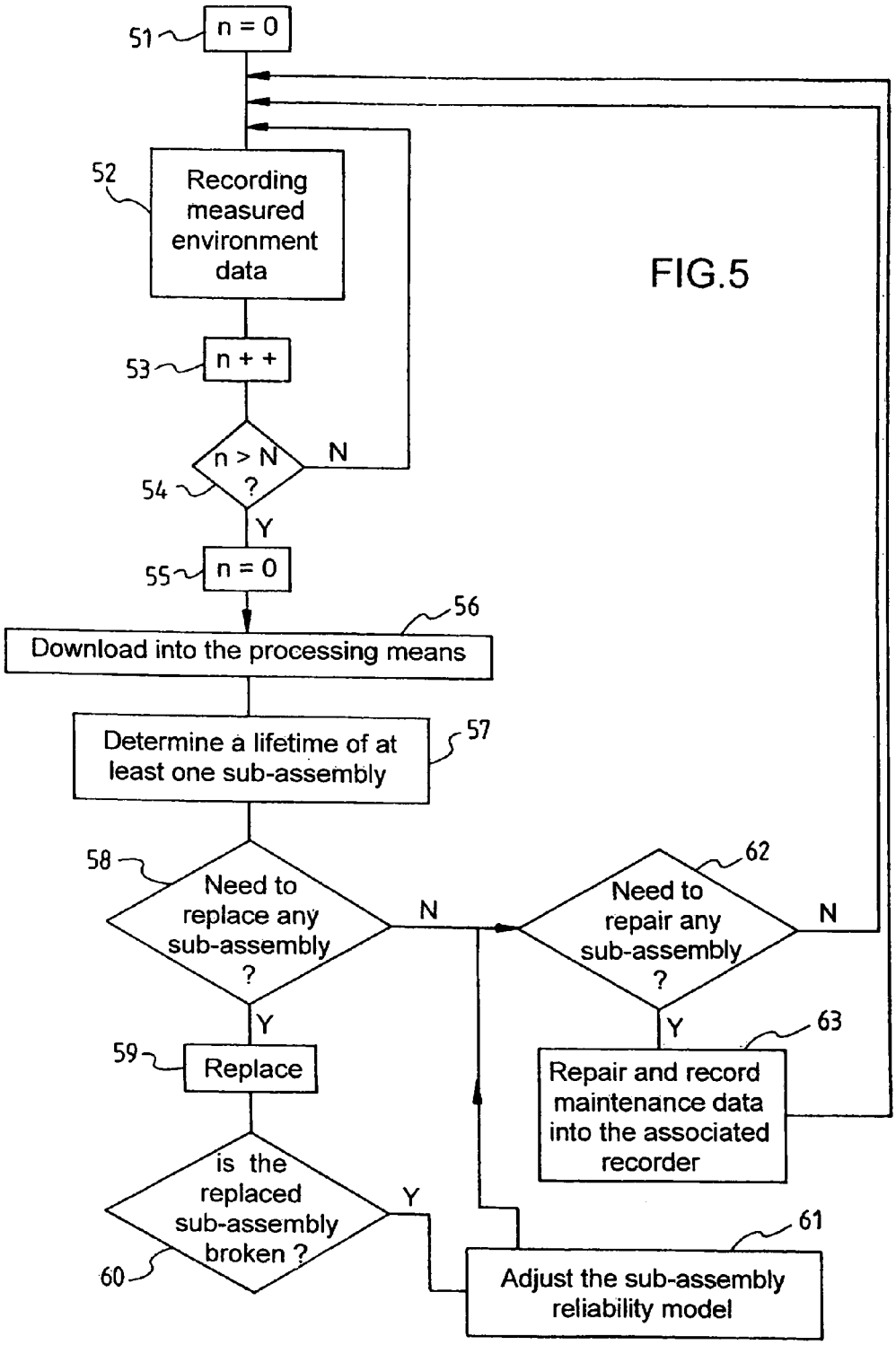
FIG. 5 illustrates an example of an algorithm for tracking a plurality of sub-assemblies according to a fourth embodiment of the present invention.

FIG. 5 illustrates an example of an algorithm for tracking a plurality of sub-assemblies of a downhole assembly according to a fourth embodiment of the present invention.

A downhole assembly comprises a plurality of sub-assemblies. A plurality of recorders is provided, each recorder allowing to individually record operating data for a determined sub-assembly among the plurality of sub-assemblies. The stored operating data are individually extractable, in particular if the determined sub-assembly is disassembled from the downhole assembly.

The recording of the measured environment data (box 52) may for example be performed following the method illustrated in FIG. 4, the method of the first alternative embodiment or the method of the second alternative embodiment.

In the example illustrated in FIG. 5, the recording (box 52) is performed several times before a downloading of the recorded operating data (box 56).

A variable is reset at a beginning of an operation (box 51). The variable is incremented (box 53) following the recording (box 52). The variable is compared to a predetermined threshold (box 54). If the variable is smaller or equal to the predetermined threshold, the recording (box 52) and the incrementing of the variable (box 53) are repeated.

If the variable is greater than the predetermined threshold, the variable is reset (box 55) and the measured environment data are downloaded into processing means, e.g. a computer (box 56), thus allowing to construct or upgrade an operating database. The computer may allow to determine a lifetime of at least one sub-assembly (box 57).

Alternatively, the resetting (box 55), the downloading (box 56) and subsequent steps may be performed upon an event such as a lifting of the downhole assembly.

The resetting (box 55), the downloading (box 56) and subsequent steps may also be performed either upon a lifting of the downhole assembly or upon a result of a comparing of a variable (box 54).

Typically, maintenance data, manufacturing data and/or any other data correlated to a state of a determined sub-assembly are stored within the associated recorder. The maintenance data and the manufacturing data may be also downloaded.

Preferably the recorders contain data in a single data format so as to facilitate a reading of each recorder of the plurality of recorders.

The operating database of a determined sub-assembly may be stored within a memory of the computer and within the associated recorder. Alternatively, a non-volatile memory of the associated recorder is partially erased after the downloading and the operating database is stored only into the memory of the computer. In this latter case, the associated recorder discloses only a portion of the operating database, typically recent data. If the determined sub-assembly is replaced or used within a distinct downhole assembly, particular care must be taken to the corresponding operating database, as the corresponding operating database is partially stored within the computer. The associated recorder hence preferably allows to store the whole operating database.

The lifetime of the at least one sub-assembly is determined (box 57) according to a sub-assembly reliability model that involves parameters of the operating database. For example, a sub-assembly reliability model of a determined sub-assembly may estimate the lifetime of the determined sub-assembly as exponentially decreasing with time and temperature. A time of manufacturing among the manufacturing data and data relating to temperatures and durations of exposures to high temperatures among the environment data allow to determine at least a probability of the lifetime of the determined sub-assembly.

The determining of the lifetime is preferably performed for a plurality of sub-assemblies.

A first test is performed to evaluate if any sub-assembly among the plurality of sub-assemblies needs to be replaced (box 58). The first test may consist in respectively comparing the determined lifetimes to a plurality of lifetime thresholds. The first test may also be performed with any other method such as a mechanical test, an electric test etc.

If none of the sub-assemblies needs to be replaced, a second test may be performed to evaluate if any sub-assembly needs to be repaired (box 62). The second test may consist in respectively comparing the determined lifetimes to a second plurality of lifetime thresholds. If for example a determined sub-assembly enters in an end-of-life period, there may be a need for replacing a piece of the sub-assembly, e.g. a seal. The second test may also be performed with any other method such as a mechanical test, an electric test etc.

If a determined sub-assembly needs to be replaced following the first test (box 58), the determined sub-assembly is replaced (box 59). A third test may be performed to evaluate whether the replaced sub-assembly is broken or not (box 60). If the replaced sub-assembly is broken, i.e. the determined sub-assembly had an effective lifetime shorter than the determined lifetime, the corresponding sub-assembly reliability model may be adjusted a posteriori (box 61). Furthermore, the associated recorder may be sent to a product center so as to provide a centralized feedback.

If the determined sub-assembly is replaced because the corresponding lifetime reaches a threshold, a state of the replaced sub-assembly may be evaluated (not represented in the algorithm of FIG. 5). The corresponding sub-assembly reliability model may be adjusted depending on the evaluated state of the replaced sub-assembly (not represented in the algorithm of FIG. 5).

If the second test (box 62) leads to a result in which no sub-assembly needs to be repaired, a recording of new measured environment data (box 52) may be performed. In a case in which a determined sub-assembly needs to be repaired, a repairing is performed and maintenance data relating to such a maintenance operation may be recorded into the associated recorder (box 63).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A downhole recorder system for use with a downhole assembly (21, 31) to be lowered into a borehole (22, 32), the downhole recorder system comprising a plurality of recorders (25*a*, 25*b*, 35*a*, 35*b*, 35*c*, 35*d*, 35*e*) each uniquely associated with a determined sub-assembly (24*a*, 24*b*, 34*a*, 34*b*, 34*c*, 34*d*, 34*e*) of the downhole assembly, at least one recorder allowing to store operating data related to the determined sub-assembly and having at least one common sensor (23, 33) communicating with at least one of the other recorders, the stored operating data being extractable at least when the determined sub-assembly is disassembled from the downhole assembly.

2. The downhole recorder system of claim 1, wherein the operating data comprise environment data relating to at least one environment parameter.

3. The downhole recorder system of claim 1, wherein the operating data comprise maintenance data.

4. The downhole recorder system of claim 1, wherein the operating data comprise manufacturing data.

5. The downhole recorder system of claim 1, wherein the at least one common sensor measures an environment parameter.

6. The downhole recorder system of claim 1, further comprising at least one sub-assembly sensor (29, 39*a*, 39*b*, 39*c*), a sub-assembly sensor being attached to a specific sub-assembly (24*b*, 34*a*, 34*b*, 34*c*), the sub-assembly sensor allowing to measure an environment parameter, the measured environment parameter being stored by the recorder (25*b*, 35*a*, 35*b*, 35*c*) associated to the sub-assembly corresponding to the sub-assembly sensor.

7. The downhole recorder system of claim 1, further comprising at least one integrated sensor (210), an integrated sensor being part of a recorder (25*a*) among the at least one recorders (25*a*, 25*b*), and the integrated sensor allowing to measure an environment parameter.

8. The downhole recorder system of claim 1, further comprising a controller (211) communicating with each recorder (25*a*, 25*b*).

9. The downhole recorder system of claim 1, further comprising:

processing means (26) located at a surface, the processing means allowing to analyze the stored operating data; and downloading means (212) to download the stored operating data from a recorder to the processing means.

10. A method for tracking a plurality of sub-assemblies of a downhole assembly (21, 31) with a downhole recorder system, the method comprising: storing operating data for each sub-assembly (24*a*, 24*b*, 34*a*, 34*b*, 34*c*, 34*d*, 34*e*) in a uniquely associated recorder, the stored operating data being individually extractable and wherein at least one recorder having at least one common sensor communicating with at least one other recorder.

11. The method of claim 10, further comprising:

measuring a value an environment parameter (box 43);

individually storing as environment data the measured value.

12. The method of claim 10, further comprising individually storing maintenance data relating to a maintenance operation performed at the determined sub-assembly.

13. The method of claim 10, further comprising:

downloading the individually stored operating data (box 56);

processing the downloaded operating data to determine a lifetime of the determined sub-assembly, according to a corresponding sub-assembly reliability model (box 57).

14. The method of claim 13, further comprising adjusting a posteriori the at least one sub-assembly reliability model with the downloaded operating data (box 61).

15. A wireline system (21) for use in a borehole (22), the wireline system comprising at least one sub-assembly (24*a*, 24*b*) and a downhole recorder system according to claim 1.

16. A drilling machine (31) for use in a borehole (32), the drilling machine comprising at least one sub-assembly (34*a*, 34*b*, 34*c*, 34*d*, 34*e*) and a downhole recorder system according to claim 1.

* * * * *